US005503121A

United States Patent [19]

Speil et al.

[11] Patent Number: 5,503,121

[45] Date of Patent: Apr. 2, 1996

[54] OIL SUPPLY FOR A VALVE ACTUATION DEVICE

[75] Inventors: Walter Speil, Ingolstadt; Arndt Ihlemann; Johann Kecker, both of Herzogenaurach, all of Germany

[73] Assignee: Ina Walzlager Schaeffler KG, Germany

[21] Appl. No.: 407,414

[22] Filed: Mar. 17, 1995

[30] Foreign Application Priority Data

Mar. 24, 1994 [DE] Germany ..... 4410123

[51] Int. Cl.[6] ..... F01L 1/44; F01L 1/12; F01M 9/10

[52] U.S. Cl. ..... 123/90.22; 123/90.35; 123/90.34

[58] Field of Search ..... 123/90.22, 90.33, 123/90.34, 90.35, 90.4, 90.48, 90.49, 90.5, 90.55

[56] References Cited

U.S. PATENT DOCUMENTS

| | | | |
|---|---|---|---|
| 2,380,051 | 7/1945 | Kettering | 123/90.4 |
| 4,537,166 | 8/1985 | Kimura et al. | 123/90.36 |
| 4,805,567 | 2/1989 | Heimburg | 123/90.22 |
| 4,924,821 | 5/1990 | Teerman | 123/90.22 |
| 5,261,361 | 11/1993 | Speil | 123/90.22 |

*Primary Examiner*—Weilun Lo
*Attorney, Agent, or Firm*—Bierman and Muserlian

[57] ABSTRACT

A device for the simultaneous actuation of two gas exchange valves (10) of an internal combustion engine by a camshaft (11) rotatably supported in a camshaft bearing (15,16), said device comprising a bridge (3) which, with the interposition of hydraulic valve clearance compensation elements (7), is in contact with valve shaft ends (9) of the gas exchange valves (10), and a guide rail (2) on which the bridge (3) is guided for longitudinal displacement by a linear bearing (5), said guide rail (2) comprising a first oil duct (18) which opens into the linear bearing (5) and a second oil duct (22) implemented in the bridge (3), which connects the valve clearance compensation elements (7) to the linear bearing (5), and the oil passes phase-wise from the first oil duct (18) into the second oil duct (22), characterized in that a third oil duct (21) branches from the first oil duct (18) and opens into the camshaft bearing (15,16).

6 Claims, 5 Drawing Sheets

OIL SUPPLY FOR A VALVE ACTUATION DEVICE

STATE OF THE ART

A device for the simultaneous actuation of two gas exchange valves of an internal combustion engine by a camshaft disposed rotatably in a camshaft bearing with a bridge which, with the interposition of hydraulic valve clearance compensation elements, is in contact with valve shaft ends of the gas exchange valves, and a guide rail on which the bridge is guided for longitudinal displacement by a linear bearing, and a guide rail comprises a first oil duct terminating in the linear bearing, and with a second oil duct in the bridge which connects the valve clearance compensation elements and the linear bearing and the oil passes phase-wise from the first duct into the second duct as the bridge moves up and down synchronously with the camshafts movements is known for example from W0-A-92/10650.

The oil under pressure passes from a gallery bore on the front face into the hollow-cylindrical guide rail. The cylindrical guide rail is set into a bore on the bridge and between the surfaces facing each other of the cylindrical guide rail and the bore, a friction bearing is placed. The oil pushes through a bore penetrating the wall thickness of the cylindrical guide rail into the gap between the cylinder faces of the bore and the guide rail or into the friction bearing. During one rotation of the camshaft, the bridge slides along the cylindrical guide rail while the two oil ducts temporarily overlap. In this phase, the oil is pumped from the first into the second oil duct and arrives, lastly, at the hydraulic valve clearance compensation elements to supply them with oil. The oil supply of the camshaft bearing in such devices is decoupled from the oil supply of the linear bearing and the hydraulic valve clearance compensation elements. Consequently, it takes place separately.

OBJECTS OF THE INVENTION

It is an object of the invention to provide such an actuation device having a common oil supply for the camshaft bearing, linear bearing and hydraulic valve clearance elements.

This and other objects and advantages will become obvious from the following detailed description.

THE INVENTION

The novel device of the invention for the simultaneous actuation of two gas exchange valves (10) of an internal combustion engine by a camshaft (11) rotatably supported in a camshaft bearing (15,16), said device comprising a bridge (3) which, with the interposition of hydraulic valve clearance compensation elements (7), is in contact with valve shaft ends (9) of the gas exchange valves (10), and a guide rail (10) on which the bridge (3) is guided for longitudinal displacement by a linear bearing (5), said guide rail (2) comprising a first oil duct (18) which opens into the linear bearing (5) and a second oil duct (22) implemented in the bridge (3), which connects the valve clearance compensation elements (7) to the linear bearing (5), and the oil passes phase-wise from the first oil duct (18) into the second oil duct (22), is characterized in that a third oil duct (21) branches from the first oil duct (18) and opens into the camshaft bearing (15,16).

This object is accomplished by the invention wherein a third oil duct branches off from the first oil duct and opens into the camshaft bearing. The oil flows under pressure through the linear bearing, the hydraulic valve clearance compensation elements and the camshaft bearing. This third oil duct is on an engine element connecting the guide rail and the camshaft bearing and on the engine element, a bearing cap piece or a bearing block is mounted. Apart from the oil supply, this engine element serves also for stabilizing the guide rail.

A particularly useful further embodiment of the invention resides in that a fourth oil duct connects the camshaft bearing with a bore which receives a cylinder head screw by which a cylinder head is fastened onto a crankcase. In the cylinder head is the fourth oil duct head of the divided camshaft bearing. In this device, it is provided that the oil flows via the various oil ducts first into the bores for the cylinder head screws, then into the camshaft bearing, then into the linear bearing and, finally into the hydraulic valve clearance compensation elements. This direction of oil flow ensures that the oil is well ventilated when it reaches the hydraulic valve clearance compensation elements.

In the above described prior art device, in contrast, it is possible that the oil does not reach the necessary degree of ventilation and, consequently, disturbances of function can occur in the hydraulic valve clearance compensation elements. In the device of the invention, a gallery bore may be provided which connects several cylinder head bores disposed in series. From the gallery bore, the oil is pressed into the cylinder head bores and from there, via the fourth oil duct, into the camshaft bearing. It is understood that in this device of the invention, it must be ensured that the cylinder head bore is sealed against the ambient environment. This can be accomplished, for example, through a seal provided between a screw head of the cylinder head screw and the associated contact face of the cylinder head.

In a further embodiment of the invention, several guide rails disposed in series are provided whose first oil ducts opens into a gallery bore arranged transversely to the guide rails in the cylinder head, from which gallery bore, oil is pressed into the first oil ducts. Via the second oil duct, the oil supplies the hydraulic valve clearance compensation elements and, parallel to it, via the third oil duct, the camshaft bearing. This further embodiment presents itself if the oil on entering the second oil duct is already sufficiently ventilated.

REFERRING NOW TO THE DRAWINGS

FIG. 1 depicts the top view onto a cylinder head (1) with a device of the invention which serves solely for better comprehension of the sectional representation explained in the following Figs. FIG. 2 shows the cylinder head (1), depicted only partially, on which is fastened a guide rail (2).

Figure 1:
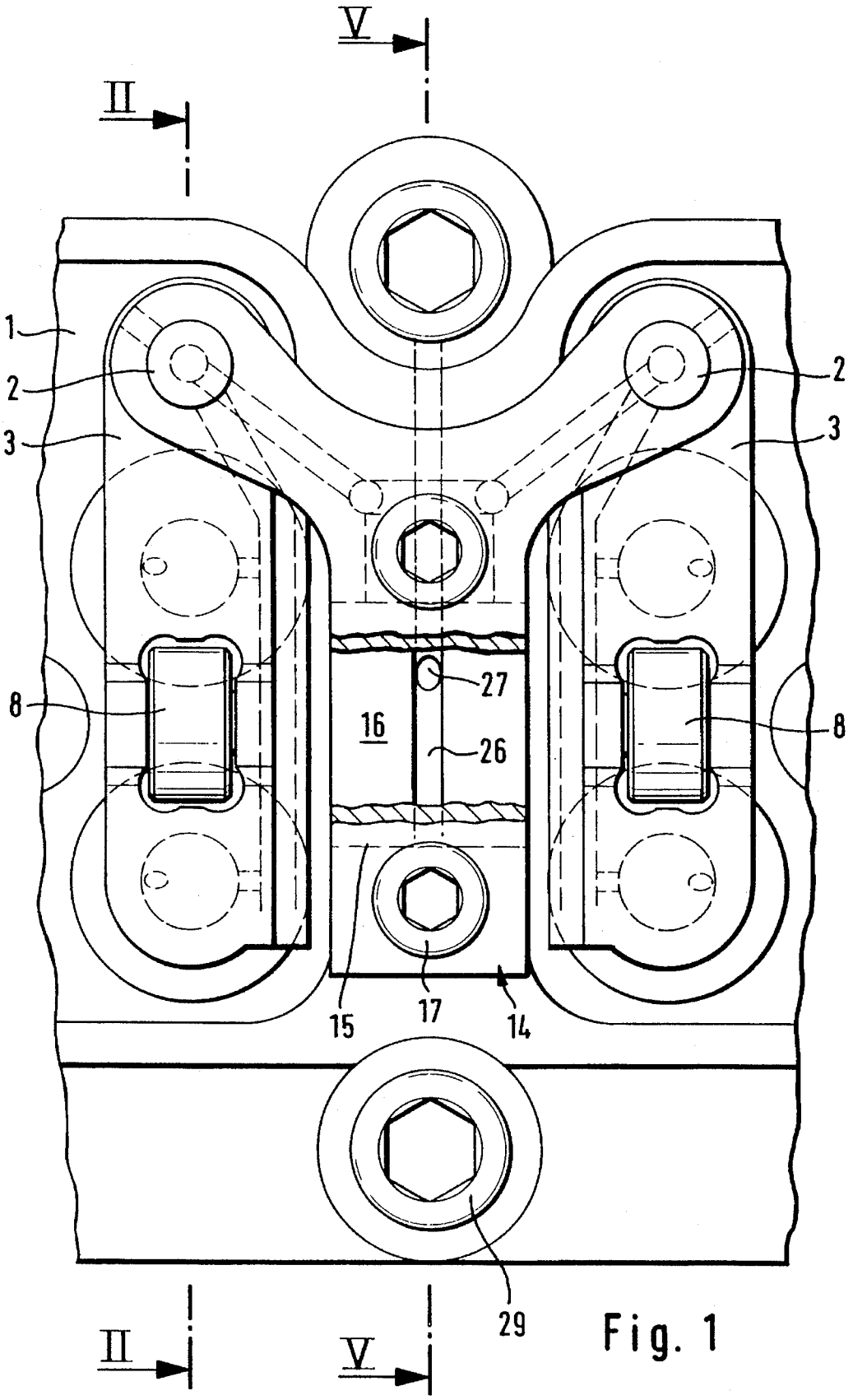
FIG. 1 is a top view onto one device of the invention.
Figure 2:
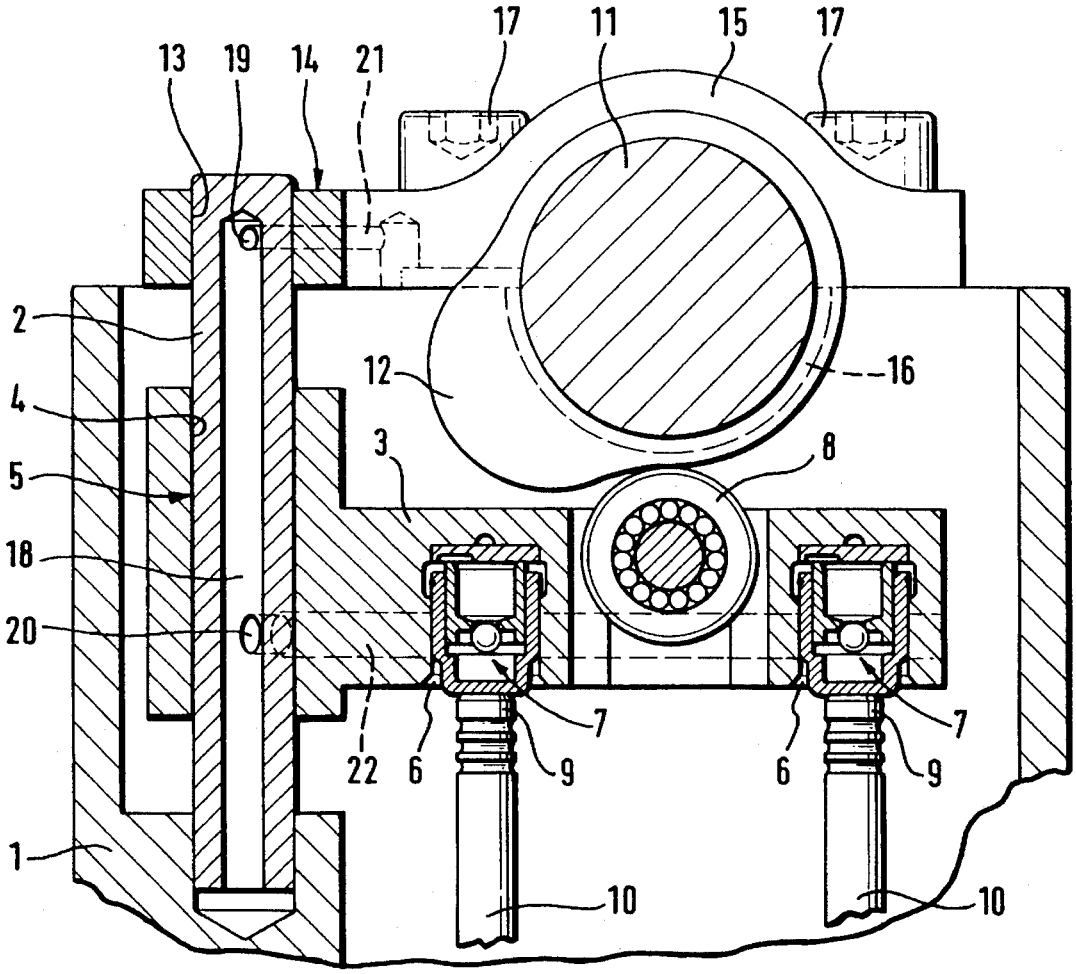
FIG. 2 is a cross-section through the device of FIG. 1 taken along line II—II.

A bridge 3 is provided with a guide bore (4) into which the guide rail (2) penetrates with low radial tolerance. The cylinder surfaces facing each other of the guide rail (2) and the guide bore (4) form the friction faces of a friction bearing (5). The bridge (3) is in this way guided for longitudinal displacement along the guide rail (2). The bridge (3) is provided with receivers (6) for hydraulic valve clearance compensation elements (7). On bridge (3), a rotatably supported roller (8) is fastened. The hydraulic valve clearance compensation elements (7) are in contact with valve shaft ends (9) of gas exchange valves (10). A camshaft (11) rotatably supported on cylinder head (1) engages the roller (8) with a cam (12). Guide rail (2) is seated with its upper end in a bore (13) of an engine element (14) on which is a bearing cap piece (15) which, together with bearing block (16) on a cylinder head (1), forms a camshaft bearing. Engine element (14) is securely screwed to the cylinder head (1) by screws (17).

The guide rail (2) is provided with an oil duct (18) in its interior. At the upper end and in the region of the friction bearing (5), are provided cross bores (19,20) which penetrate the entire wall thickness of guide rail (2). The two cross bores (19,20) connect the oil duct (18) with a further oil duct (21,22) which in this Fig. are hidden. The one oil duct (21) is on the engine element (14) and on the bearing block (16) of the cylinder head (1) and the oil duct (21) opens in bore (13) and is aligned with the cross bore (19). The other oil duct (22) is in bridge (3) and opens into the receivers (6) for the hydraulic valve clearance compensation elements (7).

Figure 3:
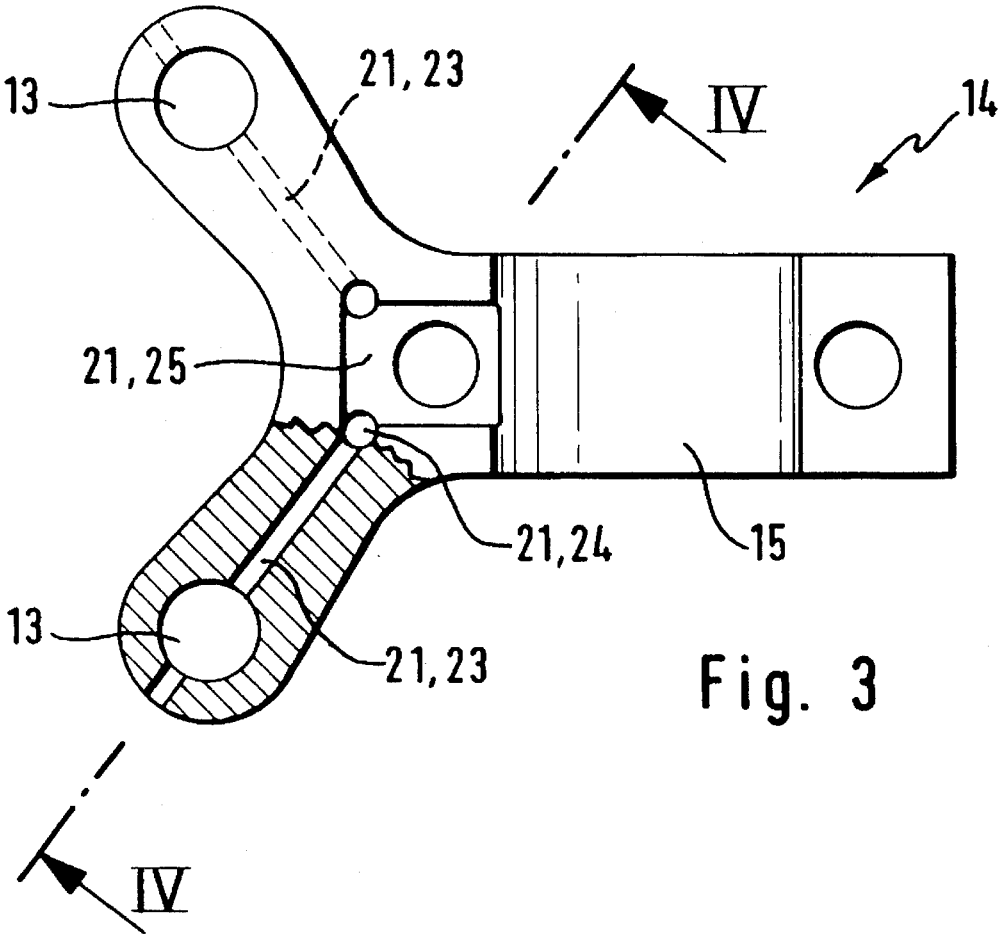
FIG. 3 is a view from below of an engine element of the device of FIGS. 1 and 2.
Figure 4:
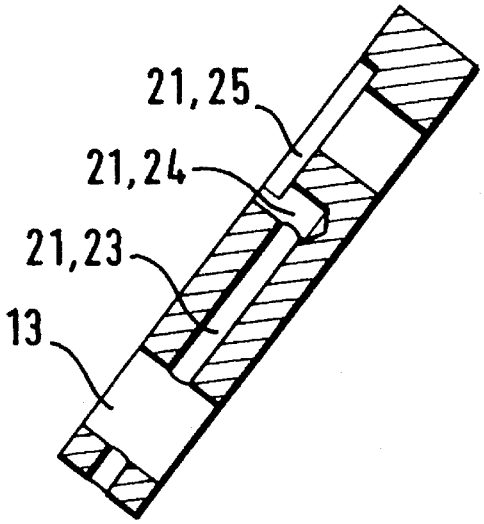
FIG. 4 is a section through the engine element of FIG. 3 taken along line IV—IV.
Figure 5:
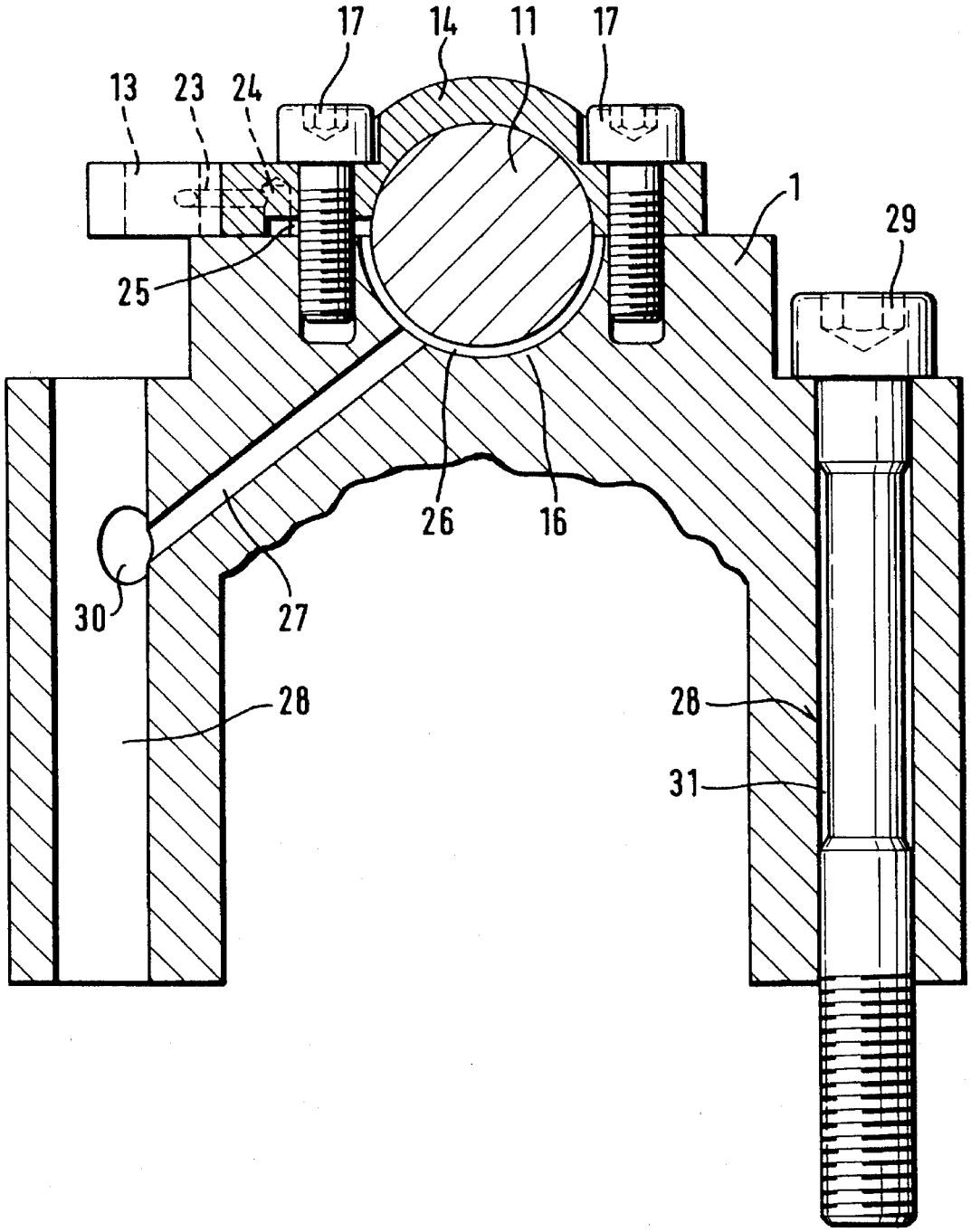
FIG. 5 is a section through the device of FIG. 1 taken along line V—V and FIG. 6 is a second device of the invention with a section as in FIG. 2.

Engine element (14) with the course of the oil duct (21) is clearly evident in FIGS. 3 and 4. A cross bore (23) starting from bore (13) opens in a pocket bore (24) disposed perpendicularly to it, which, in turn, opens into a rectangular depression (25) of the engine element (14). FIG. 5 indicates clearly the opening of the oil duct (21) in the camshaft bearing. For this purpose, on the bearing block (16), a radial groove (26) is concentric with the camshaft (11), into which the oil flows from the rectangular depression (25). Adjoining the radial groove (26) is an oblique bore (27) forming a further oil duct which opens into a cylinder head bore (28). These bores (28) receive cylinder head screws (29), by which the cylinder head (1) is fastened on a crankcase (not shown). In the present embodiments, only one of the two cylinder head screws (29) is shown. In bore (28) opens a gallery bore (30) which interconnects several bores not shown. It is evident in FIG. 5 that the entire cross section of the gallery bore (30) is arranged in the constriction area of the cylinder head screw (29). This is required so that oil can flow from the gallery bore (30) into an annular space (31) bound by the cylinder head screw (29) and the cylinder surface of the bore (28), and from there into the oblique bore (27).

The functional operation of the device of the invention will be explained in further detail in conjunction with the embodiment described above. Oil flows under pressure from the gallery bore (30) into bore (28). Via the annular space (31), the oil flows further into the oblique bore (27) and from there into the radial groove (26) of the bearing block (16). The oil flows from there via rectangular depression (25), pocket bore (24), bore (23) into the cross bore (19) of the guide rail (2). From there, the oil flows through the oil duct (18) via the cross bore (20) into the oil duct (22) and from there, into the receivers (6), or into the hydraulic valve clearance compensation elements (7). On the entire path from the gallery bore (30) to the hydraulic valve clearance compensation elements (7), the oil is increasingly ventilated so that perfectly ventilated oil arrives in the hydraulic valve clearance compensation elements (7).

Figure 6:
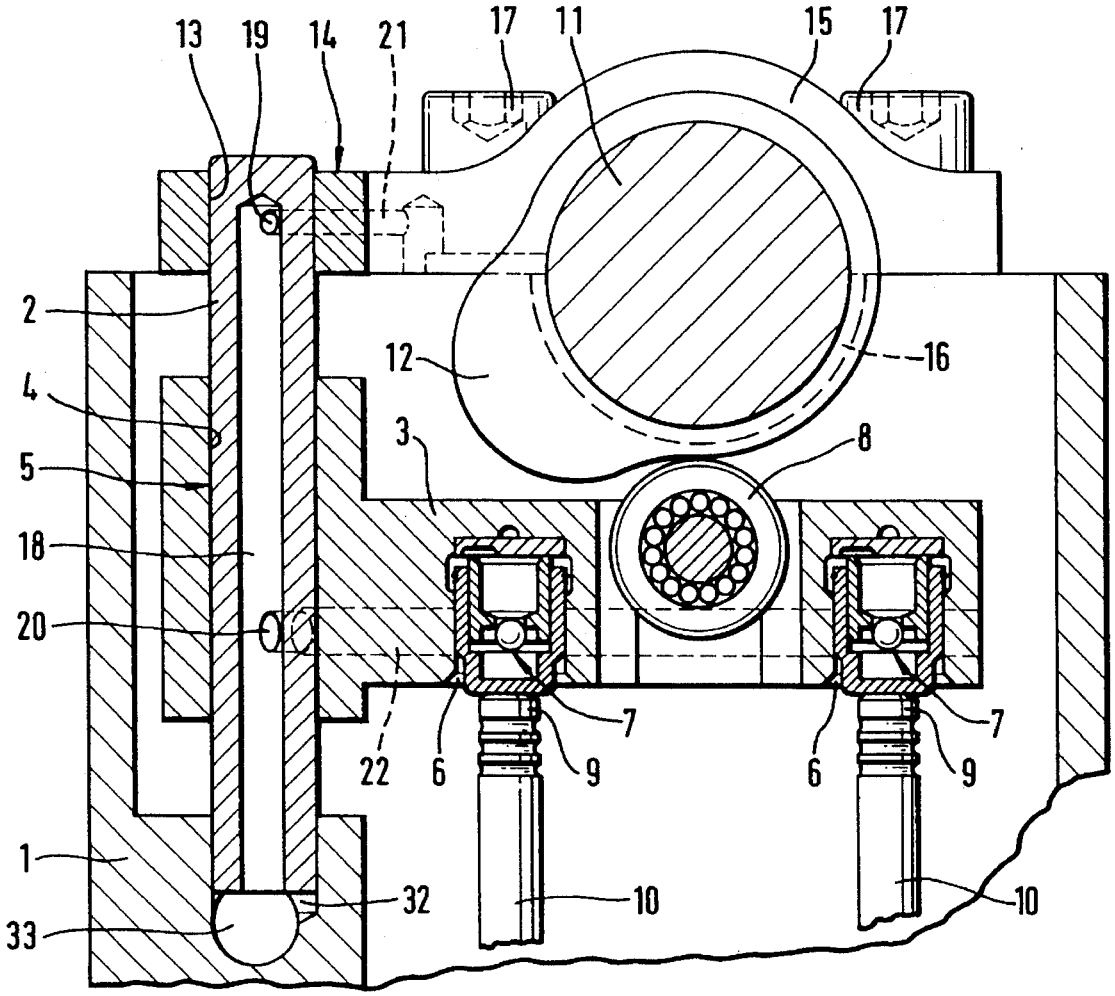

The further embodiment of the invention depicted in FIG. 6 differs from the previous embodiment in that the fourth oil duct is omitted. This means the gallery bore no longer opens into the bores but rather, as shown in FIG. 6, adjoins the first oil duct (18). The guide rail (2) is fastened in a pocket bore (32) of the cylinder head (1). In this pocket bore (32), opens a gallery bore (33) from which oil flows into the-oil duct (18) via the pocket bore (32). From there, the oil flows further through the cross bores (19,20). Starting from there, the oil flows along the same path as has been described above, but in a reverse direction. This arrangement presents itself if it is ensured that the oil is already sufficiently ventilated in the gallery bore (32).

Various modifications of the device of the invention may be made without departing from the spirit or scope thereof and it is to be understood that the invention is intended to be limited only as defined in the appended claims.

What we claim is:

1. A device for the simultaneous actuation of two gas exchange valves (10) of an internal combustion engine by a camshaft (11) rotatably supported in a camshaft bearing (15,16), said device comprising a bridge (3) which, with the interposition of hydraulic valve clearance compensation elements (7), is in contact with valve shaft ends (9) of the gas exchange valves (10), and a guide rail (2) on which the bridge (3) is guided for longitudinal displacement by a linear bearing (5), said guide rail (2) comprising a first oil duct (18) which opens into the linear bearing (5) and a second oil duct (22) implemented in the bridge (3), which connects the valve clearance compensation elements (7) to the linear bearing (5), and the oil passes phase-wise from the first oil duct (18) into the second oil duct (22), characterized in that a third oil duct (21) branches from the first oil duct (18) and opens into the camshaft bearing (15,16).

2. A device of claim 1 wherein the guide rail (2) and the camshaft bearing (15,16) are connected by an engine element (14) on which is implemented a bearing cap piece (15) or a bearing block (16) of the camshaft bearing (15,16), and the third oil duct (21) is formed in the engine element (14).

3. A device of claim 1 wherein a fourth oil duct (27) connects the camshaft bearing (15,16) with a bore (28) provided for a cylinder head screw (29).

4. A device of claim 3 wherein the fourth oil duct (27) which opens into a bearing block (16) formed on the cylinder head (1) for the divided camshaft bearing (15,16) is made in the cylinder head (1).

5. A device of claim 4 wherein several bores (28) disposed in a row for cylinder head screws (29) are provided in each of which opens one of the fourth oil ducts (27), and the bores (28) are interconnected via a gallery bore (30) from which oil flows into the bores (28).

6. A device of claim 3 wherein several guide rails (2) disposed in a row are provided whose first oil ducts (18) open into a gallery bore (33) arranged transversely to the guide rails (2) in the cylinder head (1), from which gallery bore (33) oil flows into the first oil ducts (18).

* * * * *